United States Patent [19]

Wassen et al.

[11] 4,403,491

[45] Sep. 13, 1983

[54] APPARATUS FOR FORMING A SPLIT TUBE

[75] Inventors: Johannes Wassen, Langenfeld; Siegfried Honisch, Hellenthal, both of Fed. Rep. of Germany

[73] Assignee: Mannesmann Aktiengesellschaft, Düsseldorf, Fed. Rep. of Germany

[21] Appl. No.: 317,131

[22] Filed: Nov. 2, 1981

[30] Foreign Application Priority Data

Nov. 18, 1980 [DE] Fed. Rep. of Germany ..... 3044003

[51] Int. Cl.[3] ..... B21C 1/24

[52] U.S. Cl. ..... 72/52; 72/283; 72/467; 228/17.5

[58] Field of Search ..... 72/51, 52, 283, 370, 72/166, 274, 467, 468; 228/17.5, 146, 147, 148, 150, 151

[56] References Cited

U.S. PATENT DOCUMENTS

| | | | |
|---|---|---|---|
| 228,947 | 6/1880 | Seaman | 72/283 X |
| 946,631 | 1/1910 | Ballou | 72/283 X |
| 1,004,083 | 9/1911 | Ritter | 72/283 X |
| 3,295,349 | 1/1967 | Maropis | 72/283 |
| 3,693,398 | 9/1972 | Pedersen | 72/370 X |
| 3,945,552 | 3/1976 | Tobita et al. | 228/17.5 |
| 4,148,426 | 4/1979 | Midzutani et al. | 228/146 |
| 4,204,415 | 5/1980 | Braad et al. | 72/52 |

FOREIGN PATENT DOCUMENTS

| | | | |
|---|---|---|---|
| 2805735 | 8/1979 | Fed. Rep. of Germany | 72/52 |
| 1092505 | 11/1967 | United Kingdom | 72/52 |

*Primary Examiner*—Ervin M. Combs

*Attorney, Agent, or Firm*—Ralf H. Siegemund

[57] ABSTRACT

A die member has a conical bore with a cylindrical extension, and a shallow groove in the conical bore; a conical mandrel with a cylindrical extension fills the conical bore, except for the groove which merges into an annular space between the cylindrical bore and the extension. A metal strip is pulled through the groove and the space is to be folded into a split tube.

3 Claims, 2 Drawing Figures

A-B

C-D

E-F

APPARATUS FOR FORMING A SPLIT TUBE

BACKGROUND OF THE INVENTION

The present invention relates to the folding of skelp or strip material to obtain a split tube, particularly of tubing having thin walls.

The forming of split tubes under utilization of a metal strip is, for example, carried out by means of suitable contour-rolling; see, for example, French Pat. No. 11,60,041.

Another method uses dies for forming such tubes; see, for instance, German Pat. No. 1,068,204.

German Pat. No. 597,120 describes a device for making tubes by drawing sheet stock over a mandrel and through a die. The tube's ends remain straight until forming has been completed.

Forming the strip into a tube without internal support and by drawing the strip from a coil is, for example, disclosed in U.S. Pat. No. 3,001,569.

German printed patent application No. P 28 05 735 discloses equipment for cold-forming a strip into a tube, and the joint is subsequently welded to obtain a longitudinal welding seam. This method is particularly applied to thick wall tubes which are drawn with internal as well as external support.

With the exception of this latter method, all others are disadvantaged by the fact that in the case of a thin-walled structure, the walls can easily wrinkle; particularly during formation of the round contour, folds can form in the wall.

DESCRIPTION OF THE INVENTION

It is an object of the present invention to provide a new and improved apparatus for forming a strip, particularly a thin metal strip, into a split tube pulled through the apparatus.

It is a particular object of the present invention to provide such an apparatus for making tubing having a wall thickness of 1 mm or less.

In accordance with the preferred embodiment of the present invention, it is suggested to provide a die member with a conical bore that merges into a cylindrical bore. The conical bore has a shallow groove serving as a bed for metal strips and merging into the cylindrical bore. A conical mandrel with a cylindrical extension is placed into the bore of the die member filling same, except for the groove and an annular space between the cylindrical extension and the cylindrical bore portion. A metal strip is pulled through the shallow groove to be folded into a split tube that is pulled out of the die member from said annular space.

The preferred embodiment of the invention, the objects and features of the invention, and further objects, features and advantages thereof, will be better understood from the following description taken in connection with the accompanying drawings.

DESCRIPTION OF THE DRAWINGS

Proceeding now to the detailed description of the drawings, FIG. 1 illustrates a die member 1 being contained in a housing (not shown), but being mounted therein for exchange, particularly if the dimensions of the tube to be made differ. The die member 1 is provided with a conical bore 2, constituting a gradually tapered entrance that leads toward a cylindrical bore 12.

Figure 1:
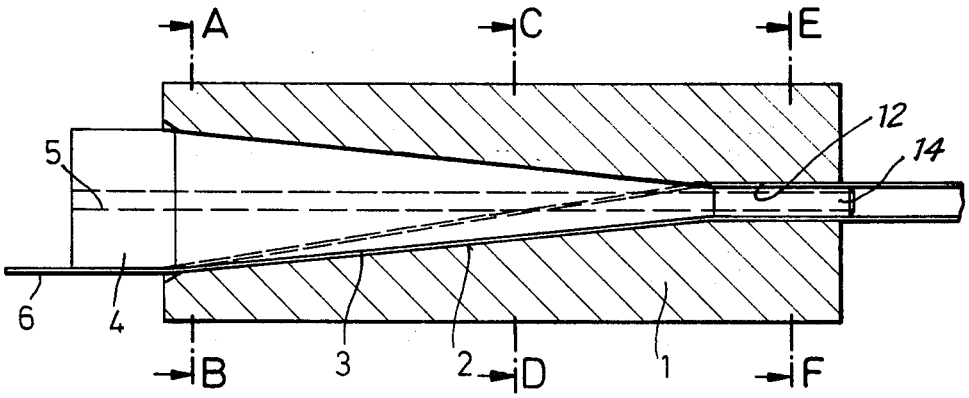
FIG. 1 is a section view through a device for practicing the preferred embodiment of the invention in accordance with the best mode thereof.
Figure 1:
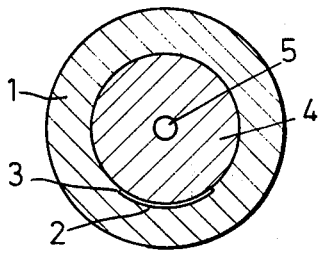
Figure 1:
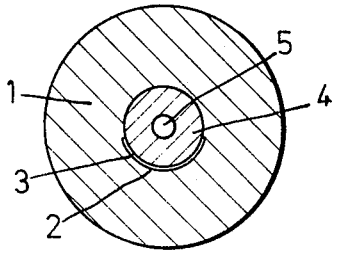
Figure 2:
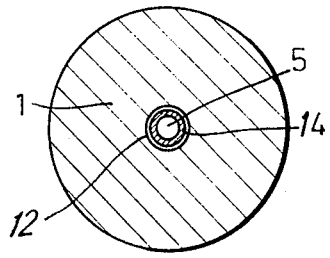
FIG. 2 illustrates three cross sections, respectively indicated by A-B, C-D, and E-F in FIG. 1.

The bore 2 is provided with a shallow groove 3 whose width remains constant as the bore 2 narrow to, thereby, cover the relatively increasing azimuthal portion of bore 2. The lateral ends of groove 3, so to speak, merge from opposite sides to, thereby, become the cylindrical bore 12.

A mandrel 4, having a bore 5, is inserted in bore 2. The mandrel is of matching conical configuration and, in effect, closes the bore, except for the groove 3. The mandrel 4 has a cylindrical extension 14 being coaxial to bore 12, and actually projecting a little therefrom. The cylindrical extension 14 is radially spaced from the cylindrical bore portion 12, and it is exactly that annular space into which the groove 3 merges. Hence, strip 6 can be fed into this die, particularly the groove 3 which shapes the strip 6 gradually into a split tube, to be withdrawn from the die member at the exit portion of the cylindrical bore 12.

It can readily be seen that the groove 3, in particular, as covered by the mandrel, defines a forming die that gradually folds even a thin metal strip into a split tube without damage to the surface and without causing the tube-strip to wrinkle. The strip-tube is pulled through the die, the strip being unwound from a coil and the tube being fed to a welding station in order to weld the joint that has resulted from now abutting edges of the strip.

The invention is not limited to the embodiments described above; but all changes and modifications thereof, not constituting departures from the spirit and scope of the invention, are intended to be included.

We claim:

1. An apparatus for forming a strip into a split tube by progressively drawing and folding said strip comprising:

a die member having a conical bore, with a wide entrance end on one side of the die member, said bore extending and merging with the member in a cylindrical bore at a narrow end of the conical bore said cylindrical bore extending in the member from said narrow end of said conical bore to an exit end on a side opposite said entrance end, said conical bore having a shallow strip forming groove formed in its surface which merges with said cylindrical bore; and a mandrel of conical configuration matchingly inserted in said conical bore, said mandrel being dimensioned to completely occupy said conical bore except for said groove, so that a strip being drawn through said groove is gradually folded into a split tube as it progresses through said bores and leaves said cylindrical bore of said die member at said exit end on said side opposite said one side.

2. An apparatus as in claim 1, said mandrel having a cylindrical extension positioned in, but radially spaced from, the cylindrical bore, said groove merging into an annular space defined between said cylindrical extension of said mandrel and the cylindrical bore, said split tube being drawn through said annular space.

3. An apparatus as in claim 1 or 2, said mandrel having a bore.

* * * * *